US007976328B2

(12) United States Patent
Tsai et al.

(10) Patent No.: US 7,976,328 B2
(45) Date of Patent: Jul. 12, 2011

(54) ELECTRICAL CONNECTOR

(75) Inventors: Cheng-Min Tsai, Hsinchu (TW); Hao-Liang Chao, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 12/567,868

(22) Filed: Sep. 28, 2009

(65) Prior Publication Data

US 2010/0227491 A1 Sep. 9, 2010

(30) Foreign Application Priority Data

Mar. 3, 2009 (TW) ..... 98106790 A

(51) Int. Cl.
*H01R 4/50* (2006.01)

(52) U.S. Cl. ..... 439/341; 439/345

(58) Field of Classification Search ..... 439/260, 439/467, 492, 494, 495, 341, 345, 376
See application file for complete search history.

(56) References Cited

U.S. PATENT DOCUMENTS

| | | | | |
|---|---|---|---|---|
| 3,701,071 | A * | 10/1972 | Landman | 200/5 R |
| 3,771,109 | A * | 11/1973 | Bruckner et al. | 439/331 |
| 3,848,946 | A * | 11/1974 | Halley et al. | 439/495 |
| 4,166,665 | A * | 9/1979 | Cutchaw | 439/196 |
| 4,193,659 | A * | 3/1980 | Deverrewaere | 439/56 |
| 4,253,719 | A * | 3/1981 | McGinley | 439/329 |
| 5,306,162 | A * | 4/1994 | Armendariz | 439/67 |
| 5,337,220 | A * | 8/1994 | Granitz | 361/816 |
| 6,083,022 | A | 7/2000 | Walkup | |
| 6,949,316 | B2 | 9/2005 | Aoki | |
| 7,134,891 | B2 * | 11/2006 | Kayama et al. | 439/260 |
| 7,438,437 | B1 | 10/2008 | Chang | |
| 2003/0017726 | A1 | 1/2003 | Pupkiewicz et al. | |
| 2004/0042203 | A1 | 3/2004 | Ladstatter | |
| 2005/0088093 | A1 | 4/2005 | Kim et al. | |
| 2008/0002403 | A1 | 1/2008 | Kim | |

FOREIGN PATENT DOCUMENTS

| | | |
|---|---|---|
| CN | 1398020 A | 2/2003 |
| CN | 2831700 | 10/2006 |
| CN | 2862425 | 1/2007 |
| CN | 200965921 | 10/2007 |

OTHER PUBLICATIONS

Chinese language office action dated Apr. 13, 2010.
English language translation of Chinese language office action dated Apr. 13, 2010.
English language translation of abstract and pertinent parts of CN 2831700 (published Oct. 25, 2006).
English language translation of abstract and pertinent parts of CN 2862425 (published Jan. 24, 2007).
English language translation of abstract of CN 200965921 (published Oct. 24, 2007).
Chinese language Office Action dated Sep. 8, 2010.

* cited by examiner

*Primary Examiner* — Thanh-Tam T Le
(74) *Attorney, Agent, or Firm* — Thomas, Kayden, Horstemeyer & Risley, LLP

(57) ABSTRACT

An electrical connector for a flexible printed circuit is provided. The electrical connector comprises a connector set, a terminal and a fasten assembly. The connector set has a base, a cover and a pin. The cover is pivotally connecting to the base by the pin and adapted to open or shut the receiving space defined by the base and the cover. The terminal is adapted to be detachably inserted into the receiving space to electrically connect the connector set. The fasten assembly is disposed on the base and the terminal respectively. When the terminal is inserted into the receiving space, the fasten assembly is adapted to fasten the terminal to the base.

4 Claims, 8 Drawing Sheets

ELECTRICAL CONNECTOR

This application claims priority to Taiwan Patent Application No. 098106790 filed on Mar. 3, 2009, the content of which is incorporated herein by reference in its entirety.

CROSS-REFERENCES TO RELATED APPLICATIONS

Not applicable.

BACKGROUND OF THE INVENTION

1. Field of the Invention

The present invention relates to an electrical connector, and more particularly, to an electrical connector for a flexible printed circuit.

2. Descriptions of the Related Art

In various electronic products, there often exist a lot of separate parts that are not formed integrally, and electrical connections among such separate parts are accomplished by flexible ribbon cables or flexible printed circuits (FPCs). As compared to flexible ribbon cables, flexible FPCs have lighter weight and smaller profiles, so they are more suitable for wiring arrangement of circuits in narrow spaces.

In practical use, an FPC is usually detachably inserted in an electrical connector disposed on a part. Such a design may not only increase the manufacturing and assembling speed in the production process, but also provide more convenience when damaged parts need to be replaced. Therefore, this kind of electrical connectors are commonly found in a wide variety of popular electronic products where emphasis is placed on light weight and a small profile, such as liquid crystal displays (LCDs), notebook computers, mobile phones and cameras.

FIGS. 1A and 1B are schematic views of a prior art electrical connector for an FPC. The electrical connector 1 comprises a base 11, a pin 12 and a cover 13. The cover 13 is pivotally disposed on the base 11 by means of the pin 12. By lifting the cover 13 upwards, a terminal portion located at a front end of the FPC can be easily inserted into a space defined by the base 11 and the cover 13, and by closing the cover 13, the connection between the FPC 14 and the electrical connector 1 can be accomplished.

The cover 13 has an increased thickness or a protrusion at a portion thereof adjacent to the pin 12, so once the FPC 14 is inserted into the electrical connector 1 and the cover 13 is closed, the portion of the cover 13 adjacent to the pin 12 will exert on the FPC 14 an additional pressing force, which is adapted to press the FPC 14 tightly between the cover 13 and the base 11 near the pin 12. In this way, the electrical connector 1 can apply a clamping force to the FPC 14 to keep an electrical connection therebetween.

However, the prior art electrical connector 1 must have a large thickness in order to withstand the stress caused by its clamping action, so the relatively large volume thereof makes internal space within the product more restricted, which is unfavorable for miniaturization of the product. Furthermore, because the joint end of the FPC is subjected to a relatively large clamping force applied by the cover, the portion thereof being clamped is liable to excessive deformation, causing the conductive copper foil printed thereon to warp and separate from the joint end.

Even worse, because the prior art electrical connector 1 relies only on the pressing action between the cover and the base without any structure capable of preventing detachment of the FPC, even a slight pulling force might cause detachment of the FPC. This would result in disconnection between two electrical components, thus preventing them from operating normally.

In view of this, it is highly desirable in the art to provide an electrical connector that is able to effectively prevent detachment of the FPC, prolong the FPC's service life, is easy to operate and allows for miniaturization of the product.

SUMMARY OF THE INVENTION

The primary objective of the present invention is to provide an electrical connector that is simple in structure, convenient to operate, and capable of preventing detachment of the FPC and protecting the copper foil conductors on the FPC.

To this end, the present invention provides an electrical connector. The electrical connector comprises a connector set, a terminal and a fasten assembly. The connector set has a base, a cover and a pin. The cover is pivotally connecting to the base by the pin and adapted to open or shut a receiving space defined by the base and the cover. The terminal is detachably inserted into the receiving space to electrically connect to the connector set. The fasten assembly has at least one protrusion and at least one first recess. The at least one protrusion and the at least one first recess are disposed on the base and the terminal respectively, and when the terminal is inserted into the receiving space, the at least one protrusion is adapted to be received in the at least one first recess.

The present invention also provides another electrical connector. The electrical connector comprises a connector set and a fasten assembly. The connector set has a base, a cover and a pin, wherein the cover is pivotally connected to the base by the pin, and adapted to open or shut a receiving space for receiving a terminal, and the fasten assembly has at least one protrusion and at least one second recess, disposed on the base and the cover respectively. When the cover shuts the receiving space, the at least one protrusion is adapted to be received in the at least one second recess.

According to the above descriptions, because the electrical connector of the present invention uses a fasten assembly to fix the FPC onto the base of the connector, it features a simple, light and thin structure. Accordingly, the electrical connector not only is easy to operate and allows for miniaturization of the product, but may also prevent detachment of the FPC from the electrical connector and protect the copper foil to prolong the service life of the FPC.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

The present invention relates to an electrical connector for a flexible printed circuit (FPC), which will be explained with reference to several embodiments thereof hereinbelow. However, descriptions of these embodiments are only for purpose of illustration but not to limit the present invention. It should be appreciated that, dimensional relationships among individual elements in the attached drawings are only drawn for ease of understanding but not to limit the actual scale.

Figure 1A:
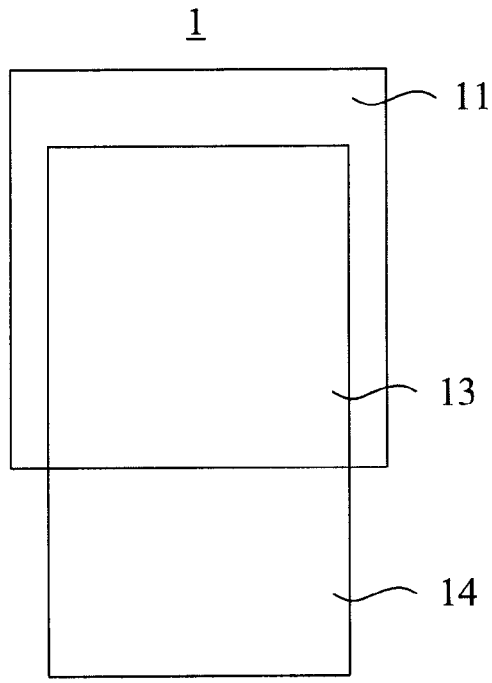
FIG. 1A (Prior Art)
FIG. 1A is a schematic view of a prior art electrical connector.
Figure 1B:
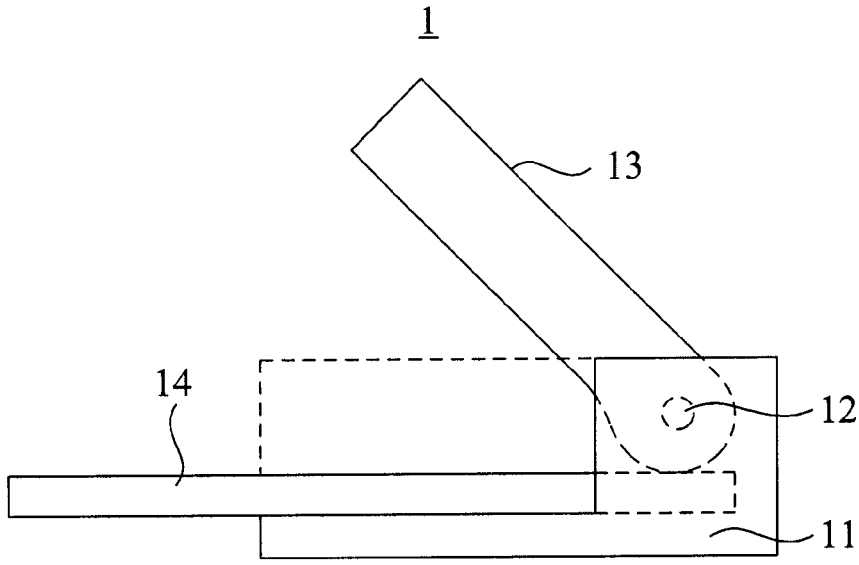
FIG. 1B (Prior Art)
FIG. 1B is a schematic view of the prior art electrical connector.
Figure 2A:
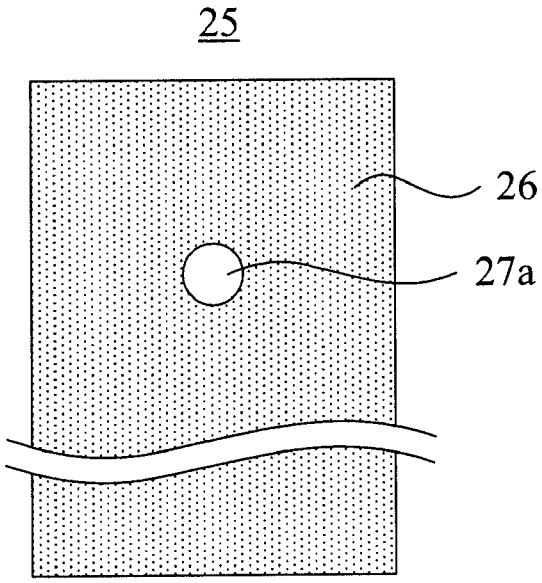
FIGS. 2A and 2B are schematic views of an electrical connector of the present invention.
Figure 2B:
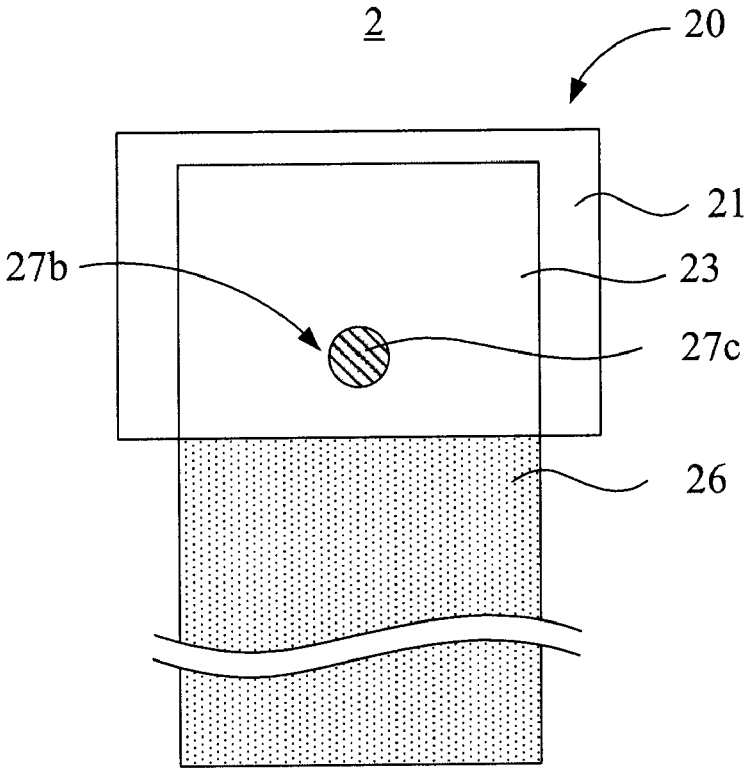

Referring to FIGS. 2A and 2B, the electrical connector 2 of the present invention comprises a connector set 20, a terminal 26 and a fasten assembly 27. The fasten assembly 27 comprises a first recess 27*a*, a second recess 27*b* and a protrusion 27*c*. The connector set 20 comprises a base 21, a pin (not shown) and a cover 23. The cover 23 is pivotally connecting to the base 21, and when the cover 23 is closed, the cover 23 and the base 21 jointly define a receiving space (not shown) for receiving a flexible printed circuit (FPC) 25. Disposed at one end of the FPC 25 is the terminal 26, which is detachably inserted into the receiving space to electrically connect to the connector set 20. The first recess 27*a*, the second recess 27*b* and the protrusion 27*c* of the fasten assembly 27 are disposed on the connector set 20 and the terminal 26 respectively corresponding to each other. For example, the first recess 27*a* is disposed on the terminal 26, the second recess 27*b* is disposed on the cover 23, and the protrusion 27*c* is disposed on the base 21, although they are not limited thereto. When the terminal 26 is inserted into the receiving space and the cover 23 is closed, the first recess 27*a* and the second recess 27*b* are adapted to jointly receive the protrusion 28*c*. Hence, the first recess 27*a* and the second recess 27*b* are adapted to be positioned by the protrusion 27*c* so that the terminal 26 can be fixed to the connector set 20 securely, and even when the FPC 25 is pulled by an undue external force, the FPC 25 thus positioned will not be detached from the connector set 20. Thereby, normal electrical connection between two parts is ensured. Hereinbelow, several embodiments of the present invention will be described in detail.

Figure 3A:
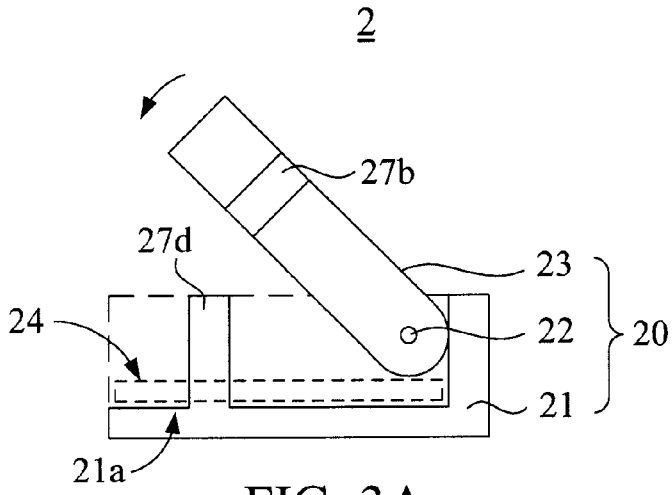
FIGS. 3A through 3C are schematic views of an electrical connector according to a first embodiment of the present invention.
Figure 3B:
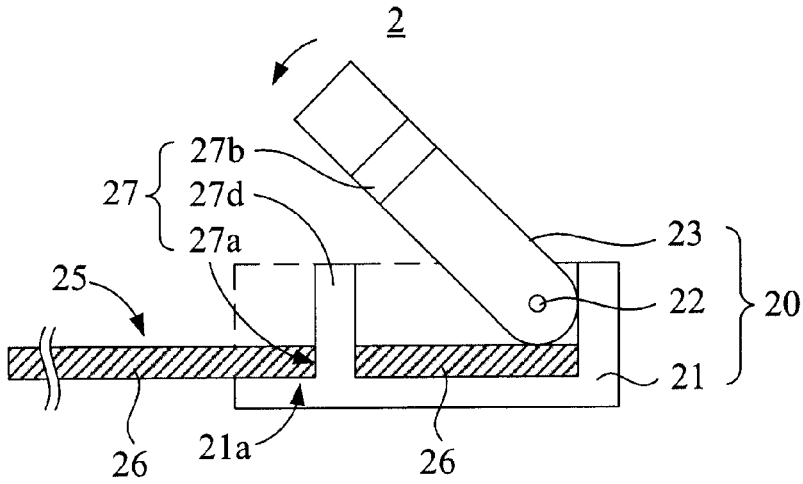
Figure 3C:
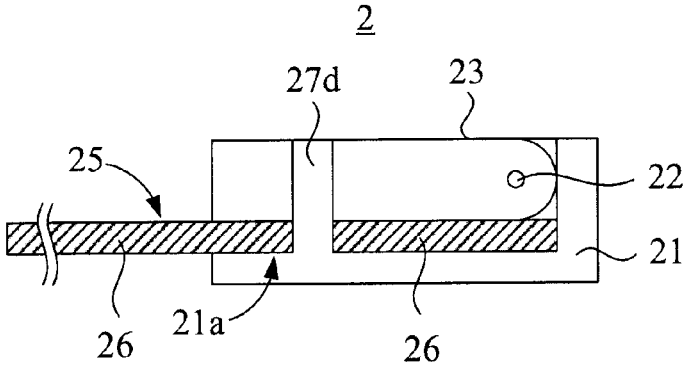
Figure 4A:
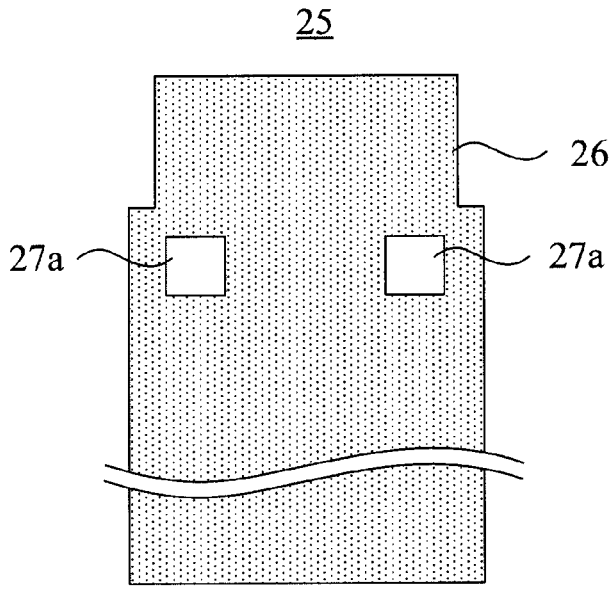
FIGS. 4A through 4E are schematic views of an electrical connector according to a second embodiment of the present invention.
Figure 4B:
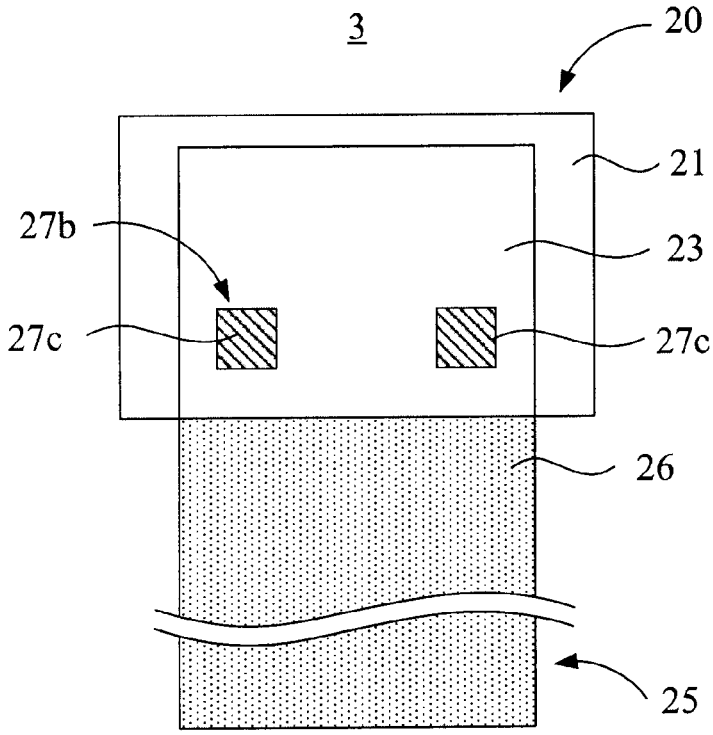
Figure 4C:
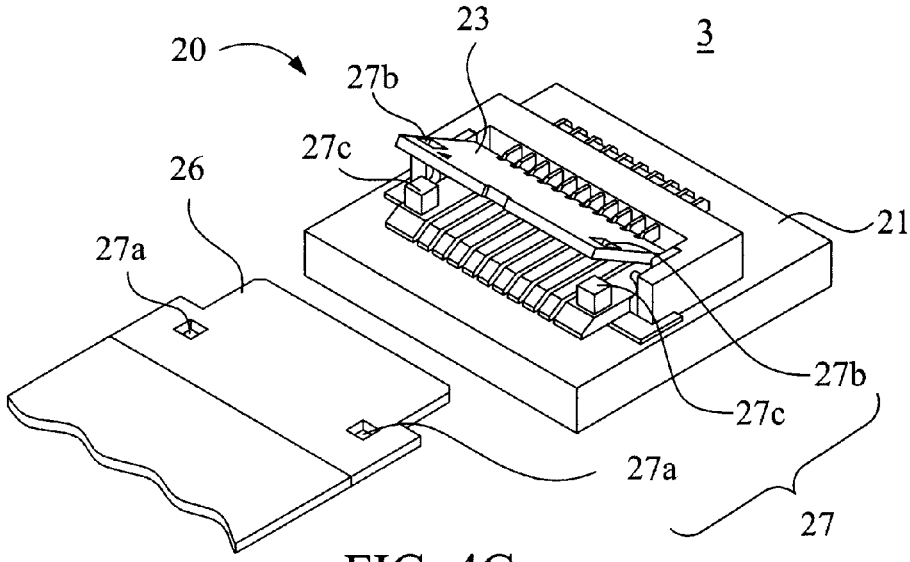
Figure 4D:
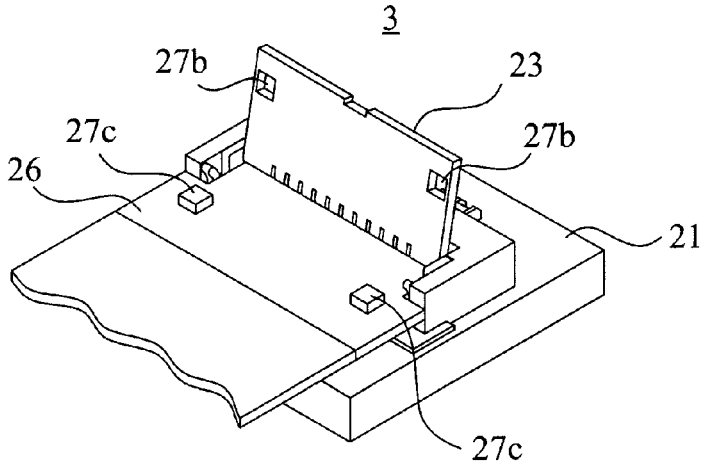
Figure 4E:
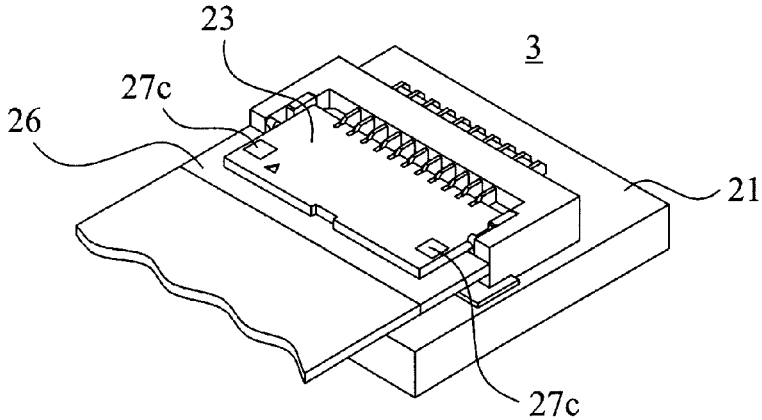

FIGS. 3A through 3C are schematic views of a first embodiment of the present invention. In this embodiment, the protrusion is formed integrally with the base 21 and extends from a top surface 21*a* of the base 21 to form a protruded pin 27*d*. When the cover 23 is closed, the receiving space 24 (the area indicated by dashed lines in FIG. 3A) is formed between the cover 23 and the top surface 21*a* of the base 21.

FIGS. 3A and 3C show statuses when the cover 23 is opened and closed respectively. To fix the terminal 26 to the connector set 20, it is simply necessary to lift the cover 23 and insert the terminal 26 into the receiving space 24 with the first recess 27*a* of the terminal 26 engaging with the protruded pin 27*d*, and then close the cover 23 with the second recess 27*b* of the cover also engaging with the protruded pin 27*d*. In this way, the terminal 26 can be positioned between the cover 23 and the base 21 securely without being detached from the connector set 20.

With this arrangement, the cover 23 of the connector set 20 may only apply a very slight pressing force to the terminal 26 while still ensuring normal electrical connection between the conductive copper foil of the terminal 26 and the connector set 20. As compared to the prior art structure, this decreases the necessary pressing force and, consequently, the thickness and volume necessary for providing a large pressing force between the cover 23 and the base 21, thereby facilitating miniaturization of the product. Particularly, without need to apply an additional pressing force in order to fix the terminal 26 securely, the electrical connector 2 of the present invention can effectively protect the conductive copper foil of the terminal 26 from undesirable wear caused by the pressing force and, therefore, prolong the service life of the FPC 25.

Depending on practical needs, modifications may be made to the amounts, shapes and positions of the protrusions and recesses in the fasten assembly of the present invention. Next, a second embodiment of the present invention will be described. Referring to FIGS. 4A through 4E, there is depicted an electrical connector 3 and an FPC 25 according to a second embodiment of the present invention. Unlike the first embodiment, the fasten assembly 27 included in the electrical connector 3 of this embodiment is located at two opposite side edges of the electrical connector 3. More specifically, the fasten assembly 27 of this embodiment has two first recesses 27*a*, two second recesses 27*b* and two protrusions 27*c*, which are disposed at two opposite side edges of the connector set 20 and the terminal 26 respectively.

The two first recesses 27*a* are disposed at two side edges of the terminal 26, the two second recesses 27*b* are disposed at two side edges of the cover 23, and the two protrusions 27*c* are also disposed at two side edges of the base 21. When the terminal 26 is inserted in the connector set 20 and the cover 23 is closed, the fasten assembly 27 at the two sides of the electrical connector 3 will fix the terminal 26 to the connector set 20 more securely to further prevent the terminal 26 from inclining relative to the connector set 20 when the terminal 26 is subjected to a lateral pulling force.

Figure 5A:
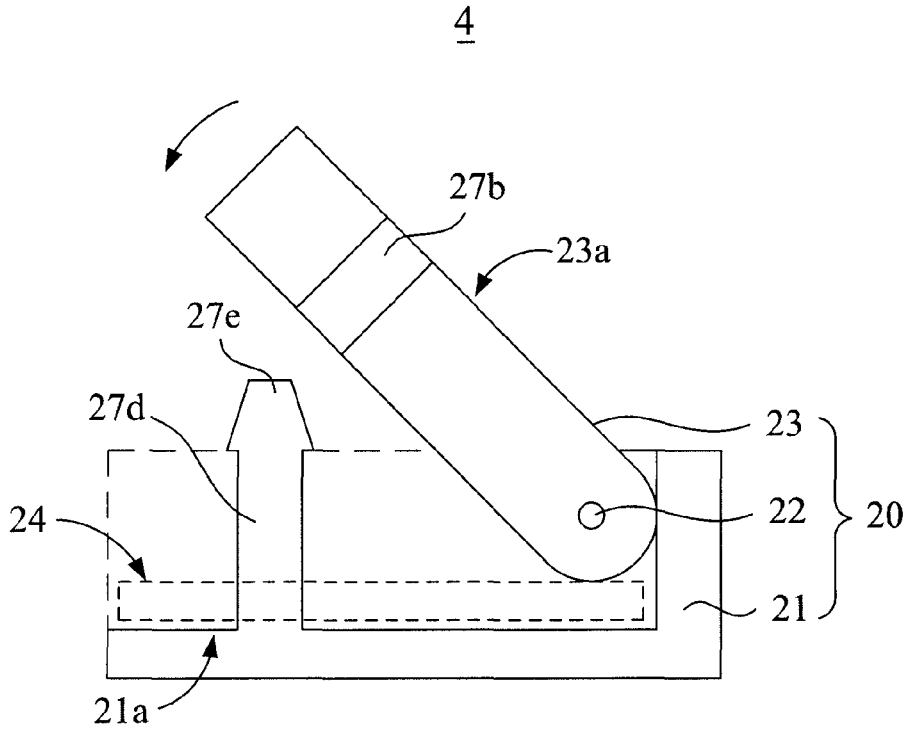
FIGS. 5A through 5B are schematic views of an electrical connector according to a third embodiment of the present invention.
Figure 5B:
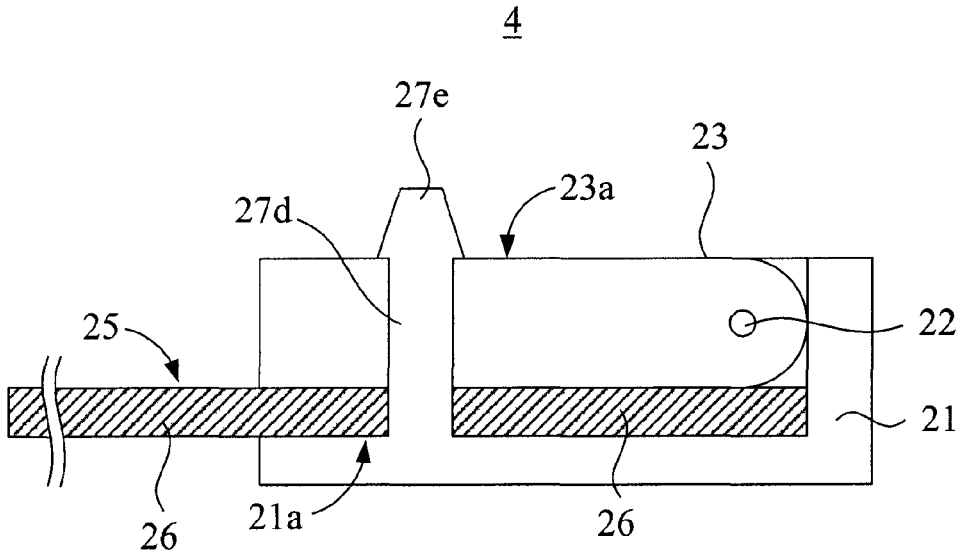

Referring to FIGS. 5A and 5B, schematic views of an electrical connector 4 and a connector set 20 according to a third embodiment of the present invention are shown therein. Unlike the first embodiment, the protruded pin 27*d* of this embodiment further comprises a snap-fit end 27*e*, with a trapezoid-like shape, disposed at the top end of the protruded pin 27*d*. The snap-fit end 27*e* of this embodiment is made of an elastic plastic, so it is adapted to be elastically deformed when being subjected to an external force. As shown, when the terminal 26 is inserted in the receiving space 24 and the cover 23 is closed, the snap-fit end of the protruded end 27*d* is adapted to be elastically deformed and protrude out of the first recess 27*a* and the second recess 27*b* to snap-fit on the top surface 23*a* of the cover 23. With this arrangement, it will be less likely for the cover 23 to be readily lifted so that the terminal 26 can be fixed to the connector set 20 more securely.

Figure 6A:
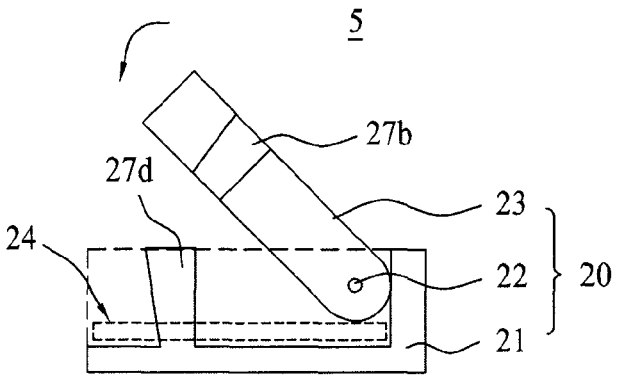
FIGS. 6A through 6C are schematic views of an electrical connector according to a fourth embodiment of the present invention.
Figure 6B:
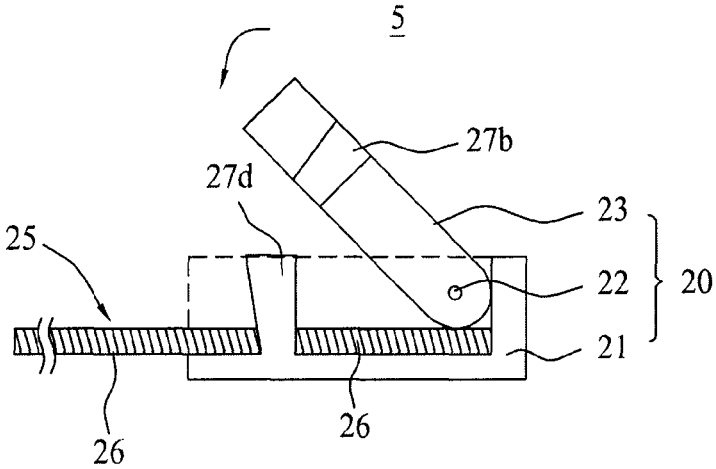
Figure 6C:
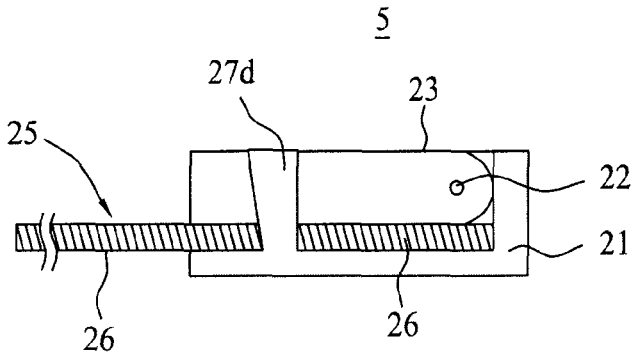

Furthermore, in reference to FIGS. 6A through 6C, schematic views of an electrical connector 5 and a connector set 20 according to a fourth embodiment of the present invention are shown therein. Unlike the first embodiment, a periphery of a horizontal cross-section of the protruded pin decreases gradually from top to bottom. That is, the protruded pin 27*d* of this embodiment has an upper end portion and a lower end portion, the periphery of the upper end portion is greater than that of the lower end portion. Similarly, the second recess 27*b* has a similar shape with the protruded pin 27*d*. That is, the periphery of a horizontal cross-section of the second recess 27*b* also decreases gradually from top to bottom for receiving the protruded pin 27*d*. Moreover, the protruded pin 27*d* is made of an elastic plastic, so it is elastically deformed when being subjected to an external force for easily being inserted into the second recess 27*b*. Before the cover 23 is closed, the terminal 26 can be firmly attached to the base 21 by the protruded pin 27*d* being inserted into the first recess 27*a* of the terminal 26. When the cover 23 is closed, the protruded pin 27*d* can be mostly received by the second recess 27*b* of the cover 23 and the first recess 27*a* of the terminal 26 so that the terminal 26 can be fixed to the connector set 20 more securely. Other detailed structures of the electrical connector 5 of this embodiment are similar to those of the aforesaid embodiment, and thus, will not be further described herein.

Figure 7A:
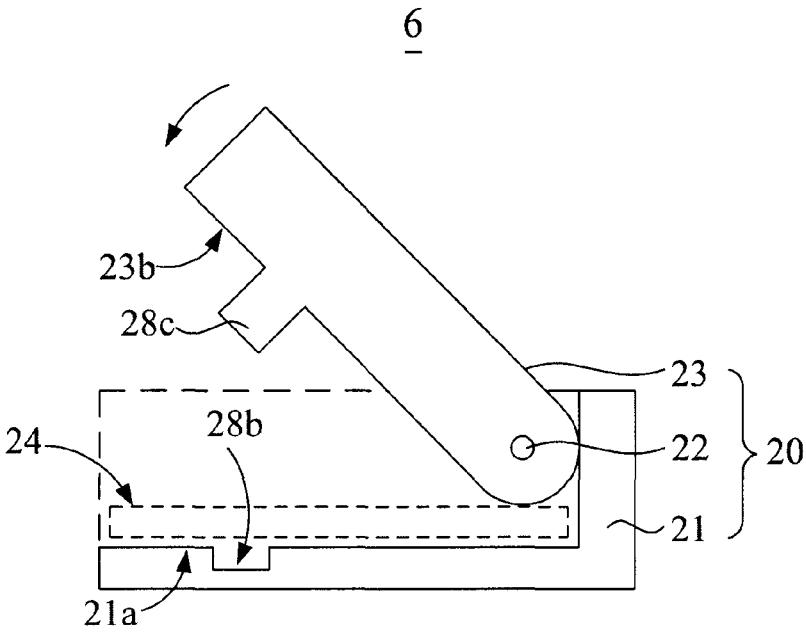
FIGS. 7A and 7B are schematic views of an electrical connector according to a fifth embodiment of the present invention.
Figure 7B:
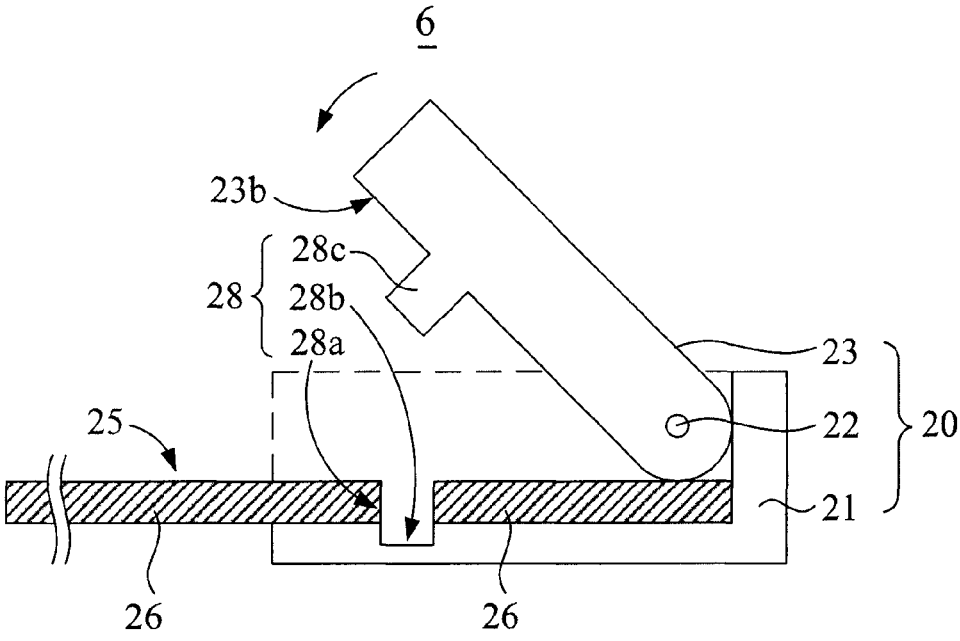

Referring to FIGS. 7A and 7B, schematic views of an electrical connector 6 and a connector set 20 according to a fifth embodiment of the present invention are shown therein. In this embodiment, the electrical connector 6 comprises a connector set 20, a terminal 26 and a fasten assembly 28. The connector set 20 comprises a base 21, a pin 22 and a cover 23. The fasten assembly 28 comprises a third recess 28*a*, a fourth recess 28*b* and a protrusion 28*c*. The third recess 28*a* is disposed on the terminal 26, the fourth recess 28*b* is disposed on the top surface 21*a* of the base 21, and the protrusion 28*c* is disposed on the bottom surface 23*b* of the cover 23.

To electrically connect the terminal 26 to the connector set 20, it is only necessary to open the cover 23, insert the terminal 26 in the receiving space 24 and then close the cover 23. Then, the third recess 28*a* and the fourth recess 28*b* will jointly receive the protrusion 28*c* of the cover 23. With this arrangement, the cover 23 can be fixed by the protrusion 28*c* to the base 21 more securely; meanwhile, the terminal 26 is also fixed by the protrusion 28*c*, making it unlikely for the terminal 26 to be detached from the connector set 20. In other examples, the shape and number of the fasten assembly 28 may vary freely, which will not be further described herein.

According to the above descriptions, by using a fasten assembly that protrudes through the FPC for fixing the FPC to the connector set, the electrical connector of the present invention makes it unlikely for the FPC to be detached from the connector set and also prevents wear of the conductive copper foil on the FPC as would occur when the FPC is detached from the connector set in the prior art solutions. With the secure fixation provided by the fasten assembly, it is unnecessary to locally apply an excessive clamping force by the connector set to the FPC, which may effectively protect and prolong the service life of the FPC by protecting it from deformation and allow for miniaturization of the product by reducing the volume necessary for providing a large clamping force. Furthermore, the FPC may be replaced by other element, which are not to be limited herein.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An electrical connector, comprising:

a connector set, having a base, a cover and a pin, the cover being pivotally connected to the base by the pin and adapted to open or shut a receiving space defined by the base and the cover;

a terminal, detachably inserted into the receiving space to electrically connect to the connector set; and a fasten assembly, having at least one protrusion, at least one first recess and at least one second recess, wherein the at least one protrusion and the at least one first recess are disposed on the base and the terminal respectively, the at least one second recess disposed on the cover and the at least one protrusion is a protruded pin, wherein a periphery of a horizontal cross-section of the at least one protruded pin decreases gradually from top to bottom, a periphery of a horizontal cross-section of the at least one second recess also decreases gradually from top to bottom so as when the terminal is inserted into the receiving space and the cover shuts the receiving space, the at least one protruded pin is adapted to be received by the at least one second recess of the cover and the at least one first recess of the terminal together; and wherein the protrusion is made of an elastic material for easily inserted into the at least one second recess.

2. The electrical connector as claimed in claim 1, wherein the at least one protruded pin extended outward from a top surface of the base and integrally formed with the base.

3. An electrical connector, comprising:

a connector set, having a base, a cover and a pin, the cover being pivotally connected to the base by the pin, adapted to open or shut a receiving space for receiving a terminal; and a fasten assembly, having at least one protrusion and at least one recess, disposed on the base and the cover respectively, wherein the at least one protrusion is a protruded pin, a periphery of a horizontal cross-section of the at least one protruded pin decreases gradually from top to bottom, a periphery of a horizontal cross-section of the at least one recess also decreases gradually from top to bottom so as when the cover shuts the receiving space, the at least one protruded pin is adapted to be received by the at least one recess; and wherein the protrusion is made of an elastic material for easily inserted into the at least one recess.

4. The electrical connector as claimed in claim 3, wherein the at least one protruded pin extended outward from a top surface of the base and integrally formed with the base.

* * * * *